US008640613B1

(12) United States Patent
Fleming et al.

(10) Patent No.: US 8,640,613 B1
(45) Date of Patent: Feb. 4, 2014

(54) AUTOMATIC WASTE COMPACTOR DRAIN SYSTEM

(76) Inventors: Garold Fleming, Springdale, AR (US); Craig Remington, Fayetteville, AR (US)

( * ) Notice: Subject to any disclaimer, the term of this patent is extended or adjusted under 35 U.S.C. 154(b) by 526 days.

(21) Appl. No.: 12/924,437

(22) Filed: Sep. 27, 2010

Related U.S. Application Data

(60) Provisional application No. 61/277,462, filed on Sep. 25, 2009.

(51) Int. Cl.
*B30B 9/04* (2006.01)

(52) U.S. Cl.
USPC ..... 100/111; 100/127

(58) Field of Classification Search
USPC ..... 100/100, 104, 110, 111, 226, 229 A, 100/246, 247, 126, 127
See application file for complete search history.

(56) References Cited

U.S. PATENT DOCUMENTS

| | | | | |
|---|---|---|---|---|
| 902,115 | A | 10/1908 | Sharp | |
| 3,212,656 | A | 10/1965 | Kamin | |
| 3,229,622 | A | 1/1966 | French et al. | |
| 3,880,072 | A | 4/1975 | Ord | 100/100 |
| 5,193,453 | A | 3/1993 | Lundy | 100/100 |
| 5,234,309 | A | 8/1993 | Foster | 414/525.9 |
| 5,490,455 | A * | 2/1996 | Conti et al. | 100/50 |
| 5,622,103 | A * | 4/1997 | Acosta et al. | 100/70 R |
| 5,676,320 | A * | 10/1997 | Merklinger | 241/101.741 |
| 6,067,900 | A | 5/2000 | Lackner et al. | 100/111 |
| 6,994,022 | B2 | 2/2006 | Paleschuck | 100/127 |
| 2006/0171612 | A1 * | 8/2006 | Paleschuck | 383/72 |

* cited by examiner

*Primary Examiner* — Jimmy T Nguyen
(74) *Attorney, Agent, or Firm* — Keisling & Pieper PLC; David B. Pieper

(57) ABSTRACT

The present invention is directed to an improved trash compactor using an automatic drain operation associated with the unloading placement of the compactor on the support pad. In accordance with one exemplary embodiment of the present invention, a pad is provided with a pad stop. The waste compactor is fitted with an extending arm that operates through a mechanical connection to open a waste gate valve when the extending arm is pushed against the pad stop during placement of the compactor on the pad. The arm is spring loaded so that the valve is automatically closed when the compactor is removed from the pad and the arm is separated from contact with the pad stop.

15 Claims, 3 Drawing Sheets

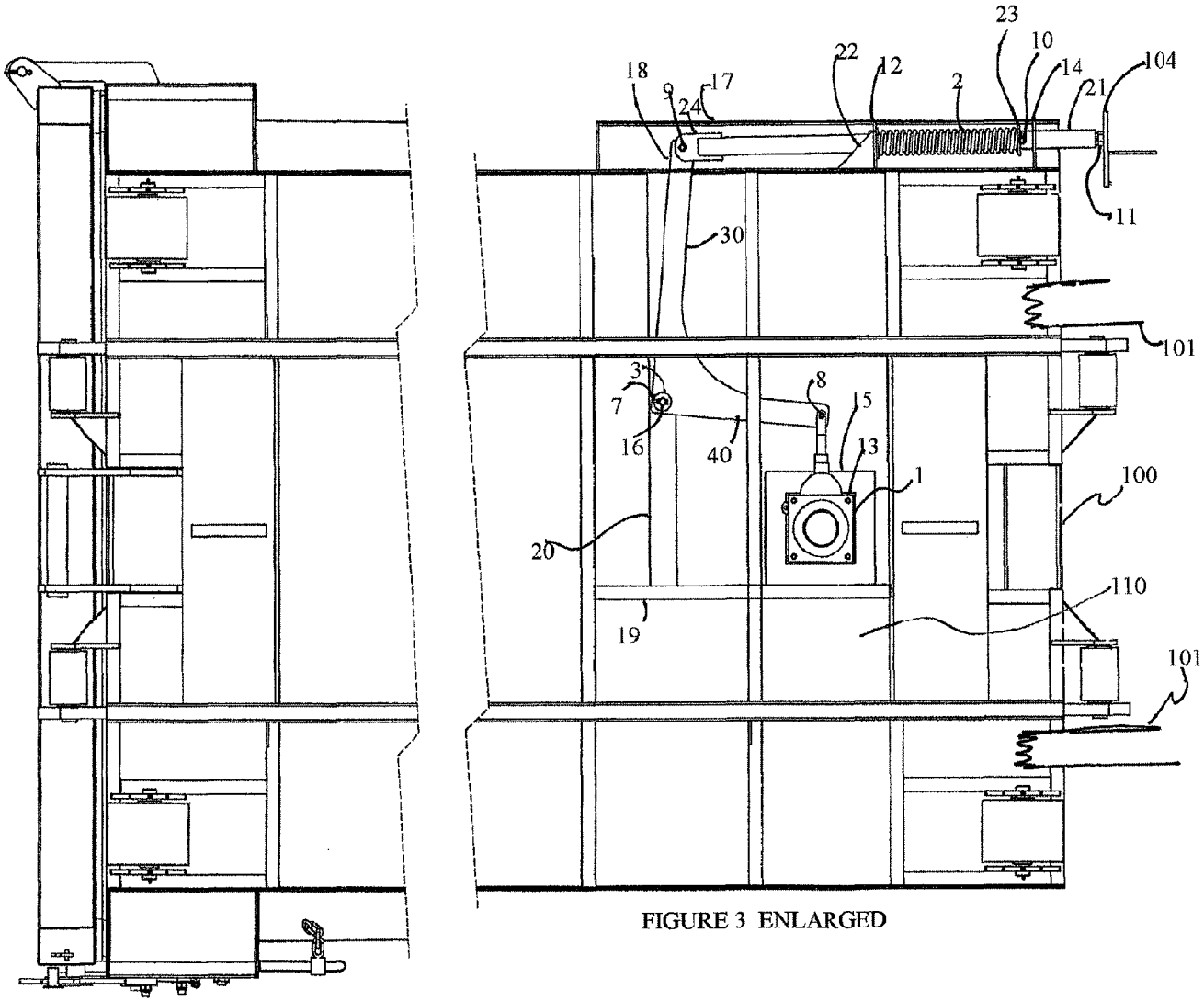
FIGURE 3 ENLARGED

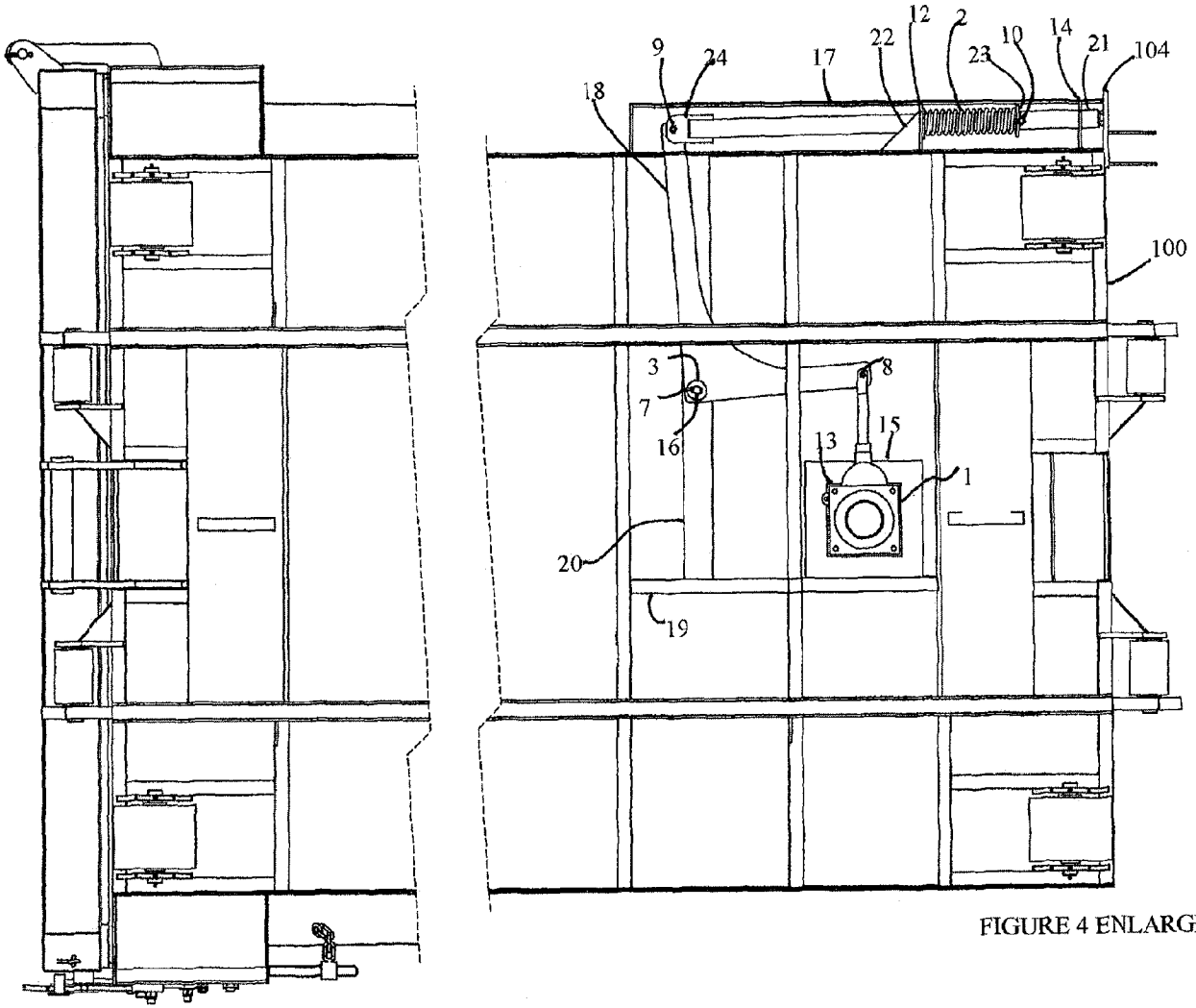
FIGURE 4 ENLARGED

AUTOMATIC WASTE COMPACTOR DRAIN SYSTEM

CROSS-REFERENCE TO RELATED APPLICATIONS

This application claims priority to and is a continuation in part of U.S. Provisional Application 61/277,462, filed Sep. 25, 2009 by Garold Flemming of Springdale, Ark. and Craig Remington of Fayetteville, Ark. ALSO entitled AUTOMATIC WASTE COMPACTOR DRAIN SYSTEM.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in drain systems for waste compactors. More particularly, the invention relates to improvements particularly suited for pad placed drain systems for automatically receiving liquid waste streams from waste compaction. In particular, the present invention relates specifically to an operating arm connected to a valve that automatically opens the valve during placement of the compactor on the compaction pad, and automatically closes the valve for transportation of the compactor.

2. Description of the Known Art

As will be appreciated by those skilled in the art, trash compactors are known in various forms. Manual drain valve systems are known on self-contained compactors. Manual systems have problems due to the driver error in forgetting to close the valves and thus dripping compactor juices onto the pad and/or streets, or the driver forgetting to open the valve when placing the unit onto the pad or use location such that liquid draining is not provided during the subsequent use of the device.

Patents disclosing information relevant to trash compactors and/or drainage systems include: U.S. Pat. No. 902,115, issued to Sharp on Oct. 27, 1908; U.S. Pat. No. 3,212,656 issued to Kamin on October 1965; U.S. Pat. No. 3,229,622 issued to French et al. on January 1966; U.S. Pat. No. 3,880,072 issued to Ord on April 1975, U.S. Pat. No. 5,193,453 issued to Lundy on March 1993; U.S. Pat. No. 5,234,309 issued to Foster on August 1993; U.S. Pat. No. 6,067,900, issued to Lackner et al. on May 30, 2000; and U.S. Pat. No. 6,994,022, issued to Paleschuck on Feb. 7, 2006. Each of these patents is hereby expressly incorporated by reference in their entirety.

Most of these patents are cited in reference to U.S. Pat. No. 6,067,900, issued to Lackner, et al. on May 30, 2000 which is entitled Trash compactor with liquid disposal. The abstract reads as follows: A trash compactor having a compactor unit and a separable trash storage container is provided that accommodates liquid within the trash that is compacted. The liquid is admitted into a reservoir within the storage container of the trash compactor where it is isolated from the compacted trash. When the storage container is removed to a disposal site, the compacted trash is emptied and the liquid from the reservoir is also emptied at the disposal site. For trash that has a large volumetric quantity of liquid, an overflow tank may be provided in the storage container to receive the overflow from the reservoir within the storage container. The overflow tank may also receive liquid that accumulates in the compactor unit while the compactor is operating.

U.S. Pat. No. 6,994,022, issued to Paleschuck on Feb. 7, 2006 is entitled Aircraft Trash Management System. The abstract reads as follows: An aircraft trash management system including a, trash bag, a trash compactor, a modified bilge drain valve and an improved control valve assembly. The trash bag has a porous bottom and non-porous sides. The bottom of the trash bag is impregnated with a non-leaching antibacterial and a leaching enzyme. The trash compactor has two chambers separated by a movable wall. One chamber is the compacting chamber and is sealable from ambient cabin pressure and the other chamber is always open to cabin pressure. The bottom of the compacting chamber is provided with an upper drain and a lower drain. The modified bilge valve provides a fluid path to the atmosphere outside the aircraft. The inventor also relates to a central valve assembly for simultaneous compacting and draining.

From these prior references it may be seen that these prior art patents are very limited in their teaching and utilization, and an improved automatic drain trash container is needed to overcome these limitations.

SUMMARY OF THE INVENTION

The present invention is directed to an improved trash compactor using an automatic drain operation associated with the unloading placement of the compactor on the support pad. In accordance with one exemplary embodiment of the present invention, a pad is provided with a pad stop. The waste compactor is fitted with an extending arm positioned to contact the pad stop when the compactor is placed onto the pad. The extending arm also operates through a mechanical connection to open a waste gate valve when the extending arm is pushed against the pad stop during placement of the compactor on the pad. The extending arm on the compactor is spring loaded so that the valve on the compactor is automatically closed when the compactor is removed from the pad and the arm is separated from contact with the pad stop. It is an object of this invention to provide an automatic waste valve operation that is not dependent on an operator remembering to open and close a manual valve. These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views:

FIG. 3 shows a bottom view of the waste compactor of FIG. 1 with the compactor pulled away from the pad stop to extend the push arm assembly.

FIG. 4 shows the bottom view FIG. 3 with the compactor pushed up against the pad stop to compact the push arm assembly.

DETAILED DESCRIPTION OF THE INVENTION

Figure 1:
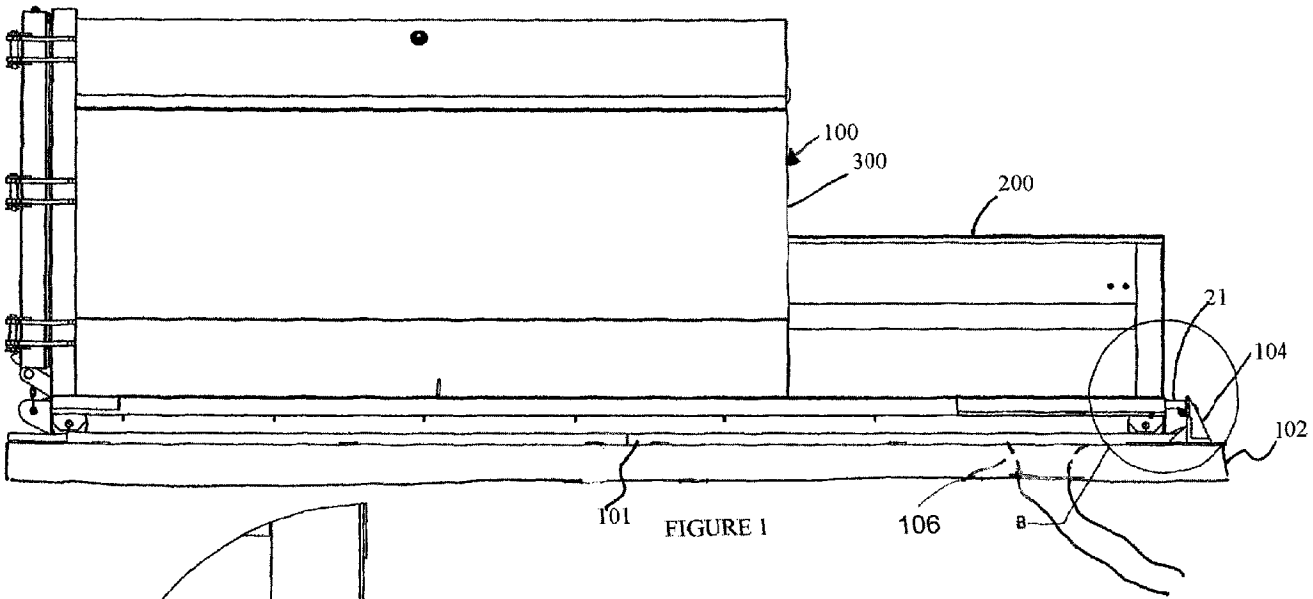
FIG. 1 is a side view of a waste compactor.

The preferred embodiment of the present invention is directed to an automatic self-contained compactor drain system. This system uses a valve 1 located in the bottom floor 110 of a self-contained compactor 100 to gravity drain liquids from the compacted waste into drain 106 positioned on the pad 102. The valve 1 is actuated by a mechanical connection that opens when the compactor 100 is placed in position on a pad 102 at the use location. The mechanical connection closes the valve when the waste hauler pulls the compactor onto the transport truck. This allows for fluids to be removed from the compacted waste and disposed of by the user instead of having to pay transport and dumping fees for the liquid. This becomes very important when dealing with valuable fluid streams such as oil that can be sold for a profit when separated from the solid waste in the compactor. This also reduces the weight of the waste that is to be hauled off, thus reducing by-weight disposal fees. The user can either capture the fluid stream for recycling or drain the waste stream into a sewer or other disposal system as appropriate for the fluid stream that is being captured.

Figure 2:
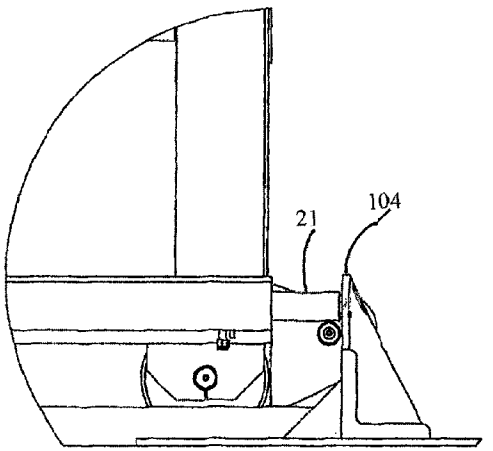
FIG. 2 is an enlarged side view of a portion of the waste compactor of FIG. 1.

As shown in FIGS. 1, 2, 3, and 4 of the drawings, a trash compactor 100 having a compactor unit 200 and a separable trash storage container 300 is provided. FIG. 1 shows the trash compactor 100 in place on the rails 101 of the pad 102 with the push arm assembly 21 contacting the pad stop 104 and thereby moving the valve to the open position. FIG. 2 shows an enlarged view of the push arm assembly shown in FIG. 1. FIG. 4 shows the same area from underneath with the pad 102 removed for clarity and the pad rails 101 cut away to show the relative positioning of the drain 106 in association with the valve 1 and the push arm assembly 21 contacting the pad stop 104. FIG. 3 shows the same area of view, but now shows the trash compactor 100 pulled away from the pad stop 104 with the push arm assembly 21 allowed to extend to close the valve 1. Operation of the push arm assembly 21 and the valve 1 may best be understood by FIG. 3 and FIG. 4.

FIGS. 3 and 4 shows the underside of the trash compactor 100. Beginning at the exposed end of the push arm 21, we see that a push arm screw 11 is adjustably threaded into the push arm 21. The push arm screw is made from a threaded rod with a hex nut welded onto the end to allow adjustment of the push arm screw 11 into and out of the push arm assembly 21. This allows for adjustments to individual site conditions for the pad stop 104. The push arm assembly 21 is slidably supported by the push arm support 14. The push arm support is fixed to the bottom of the trash compactor 100 and the push arm guard 17 by welding. Continuing inward on the push arm assembly 21, a nut and screw 10 are used to hold a spring biasing plate 23 in position on the push arm assembly 21. The spring 2 pushes against this spring biasing plate 23 to bias the push arm assembly 21 to the extended position. The other end of the spring 2 presses against the retainer ring 12. The retainer ring has an aperture small than the spring diameter but larger than the push arm assembly 21 to also slideably support the push arm assembly 21. The retainer ring is mounted by welding to the trash compactor 100 using gussets 22 and push arm guard 17. The inner end of the push arm assembly 21 has a clevis end 24 that is pivotally connected to the first end of the pivot arm 18 by a nut and first pivot arm screw 9.

The pivot arm 18 is pivotally mounted off of the bottom of the trash compactor 100 using a second hole pivotally fitting over a pivot pin assembly 16. The pivot pin assembly 16 is welded to a pivot pin support 20 that is welded to the trash compactor 100 using a channel 19. The pivot pin support 20 supports one side of the pivot arm 18, and the other side of the pivot arm is held on the pivot pin assembly 16 by a floating washer 3 that is retained by a screw and nut assembly 7 that passes through the pivot pin 16.

The inner end of the pivot arm 18 also has another pivot hole that is pivotally connected by a nut and screw 8 to the operating arm of the knife valve 1. One may observe that the pivot arm 18 has two different lengths of extension 30, 40 to change the relative operating movement of the other components. These lengths of extension occur with the first length of extension 30 from the floating pivot screw 7 to first pivot arm screw 9 and the second length of extension 40 from floating pivot screw 7 to the operating arm retention screw 8. Thus, the first pivot length goes from the pivot pin assembly 16 to the push arm assembly 21, and the second length goes from the pivot pin assembly 16 to the operating arm of the knife valve 1. These two different lengths allows for the connections to occur at different radiuses from the pivot pin to provide different ranges of motion for the push arm assembly 21 and the knife valve 1. This movement can be seen by comparing FIGS. 3 and 4. In the preferred embodiment shown, the first pivot length is longer than the second pivot length such that the push arm assembly 21 has a greater range of travel than the knife valve 1. It is envisioned that different pivot arm 18 designs would be used as appropriate depending on different arrangements. It should also be noted that we chose to use the offset design of the present invention to allow access to the push arm assembly from the side of the compactor for easy repairs. It is also envisioned that push arm assembly 21 could be centrally mounted and directly connected to the knife valve 1 such that the movements are directly coordinated. Also anticipated is the use of an extended length spring or a shock absorbing extension to protect the knife valve 1 from excessive external forces.

The knife valve 1 is flowably connected to control access to the inside of the trash compactor 100. The casing of the knife valve 1 is sealably mounted using a gasket 13 sealing the knife valve 1 to a fastener plate assembly 15 that is welded to the bottom of the trash compactor using a channel 19. The valve 1 is shown as a knife valve that may be placed in any appropriate drain location on the trash compactor 100. In this Figure, the valve 1 is shown close to the operating end 110 of the trash compactor 100 where the push arm assembly 21 contacts the pad stop 104.

Reference numerals used throughout the detailed description and the drawings correspond to the following elements:

knife valve 1
push arm spring 2
floating washer 3
floating pivot screw 7
operating arm retention screw 8
first pivot arm screw 9
spring retention screw 10
push arm end screw 11
retainer ring 12 valve gasket 13
push arm support 14
fastener plate assembly 15
pivot pin assembly 16
push arm guard 17
pivot arm 18
valve support channel 19
pivot pin support 20
push arm assembly 21
gussets 22
spring biasing plate 23
clevis end 24
a trash compactor 100
rails 101
pad 102
pad stop 104
pad drain 106
bottom floor 110
compactor unit 200
separable trash storage container 300

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element: The words 'defining,' 'having,' or 'including' Should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. An automatic drain valve apparatus for a trash compactor using a compactor unit to compact waste into a trash storage container; the apparatus comprising:

a pad including container position rails, a pad drain, and a pad stop; and a trash compactor including a drain valve positioned to flowably correspond with the pad drain when the trash compactor is placed on the pad, the drain valve flowably connected to drain liquid from the trash compactor to the pad drain, the trash compactor further including a push arm operably connected to open the drain valve when contacting the pad stop and biased to close the drain valve when moved away from the pad stop.

2. The apparatus of claim 1, the drain valve comprising:

a knife valve.

3. The apparatus of claim 1, the push arm including an adjustable push arm end screw.

4. The apparatus of claim 1, the push arm biased by a push arm spring.

5. The apparatus of claim 4, the push arm spring captured between a retainer ring secured to the compactor and a spring biasing plate secured to the push arm.

6. The apparatus of claim 1, further comprising:

a pivot arm connected between the push arm and the valve.

7. The apparatus of claim 6, the pivot arm having two different lengths of extension.

8. An automatic drain valve apparatus for a trash compactor using a compactor unit to compact waste into a trash storage container positioned on a pad including a pad drain and a pad stop, the apparatus comprising:

a trash compactor including a drain valve positioned to flowably correspond with the pad drain when the trash compactor is placed on the pad, the drain valve flowably connected to drain liquid from the trash compactor to the pad drain, the trash compactor further including a push arm operably connected to open the drain valve when contacting the pad stop and biased to close the drain valve when moved away from the pad stop.

9. The apparatus of claim 8, the drain valve comprising:

a knife valve.

10. The apparatus of claim 8, the push arm including an adjustable push arm end screw.

11. The apparatus of claim 8, the push arm biased by a push arm spring.

12. The apparatus of claim 11, the push arm spring captured between a retainer ring secured to the compactor and a spring biasing plate secured to the push arm.

13. The apparatus of claim 8, further comprising:

a pivot arm connected between the push arm and the valve.

14. The apparatus of claim 13, the pivot arm having two different lengths of extension.

15. A compactor liquid waste drain valve operating apparatus for a waste compactor having a compacted waste container with a bottom floor, the compacted waste container configured to be removably positioned on a stationary pad, the apparatus comprising:

a pad positioning element;

a liquid drain valve communicating with said container;

an operating member adapted to co-operate with said pad position element; and a mechanical linkage for opening and closing said valve, said linkage biased to close said valve in absence of co-operation of the operating member and pad position element and open said valve during co-operation of the operating member and pad position element.

* * * * *